United States Patent [19]

Rubin et al.

[11] Patent Number: 4,528,039

[45] Date of Patent: Jul. 9, 1985

[54] ALKALINE CLEANING COMPOSITIONS NON-CORROSIVE TOWARD ALUMINUM SURFACES

[75] Inventors: Fred K. Rubin, Leonia; David Van Blarcom, West Milford; Daniel J. Fox, Hawthorne, all of

[73] Assignee: Lever Brothers Company, New York, N.Y.

[21] Appl. No.: 592,482

[22] Filed: Mar. 23, 1984

Related U.S. Application Data

[63] Continuation-in-part of Ser. No. 465,710, Feb. 11, 1983, Pat. No. 4,457,322.

[51] Int. Cl.[3] ..... C23G 1/22

[52] U.S. Cl. ..... 134/2; 134/29; 134/40; 252/135; 252/139; 252/140; 252/174.14

[58] Field of Search ..... 134/2, 29, 40; 252/135, 252/139, 140, 174.14

[56] References Cited

U.S. PATENT DOCUMENTS 2,303,398 12/1942 Schwartz .
2,748,035 5/1956 Duncan ..... 134/2
2,836,566 5/1958 Duncan ..... 134/2 X
3,655,582 4/1972 Dupre et al. .
4,048,121 9/1977 Chang .
4,093,566 6/1978 MacNamara et al. .
4,116,849 9/1978 Leikhim .
4,116,851 9/1978 Rupe et al. .

FOREIGN PATENT DOCUMENTS 49-130904 12/1974 Japan .

*Primary Examiner*—Marc L. Caroff
*Attorney, Agent, or Firm*—Milton L. Honig; James J. Farrell

[57] ABSTRACT

An alkaline composition and method of cleaning aluminum surfaces is disclosed which avoids discoloring or tarnishing of the metal surface. The composition comprises a mixture of alkali metal metasilicate and a compound chosen from the group consisting of sodium carbonate, potassium carbonate, lithium carbonate, potassium orthophosphate and sodium orthophosphate and mixtures thereof, wherein the metasilicate salt is present in an effective amount up to about 3% by weight of the composition and wherein the pH ranges above about 12.0.

10 Claims, No Drawings

ALKALINE CLEANING COMPOSITIONS NON-CORROSIVE TOWARD ALUMINUM SURFACES

This application is a continuation-in-part of Ser. No. 465,710, filed Feb. 11, 1983, now U.S. Pat. No. 4,457,322.

BACKGROUND OF THE INVENTION

I. Field of the Invention

This invention relates to aqueous compositions and processes for using these in cleaning aluminum surfaces without causing significant discoloring or tarnishing of the metal. More specifically, the invention concerns the use of small amounts of sodium metasilicate alongside either alkali metal carbonates or orthophosphates in cleaning formulations to substantially reduce or altogether prevent alkali attack on aluminum.

II. The Prior Art

Highly alkaline solutions have proved very effective for the cleaning of soft metals such as aluminum. These solutions easily remove baked-on food, oleo resinous films, fatty soils, oxidized hydrocarbons, waxy deposits, carbonaceous soils and similar encrustations which are difficult to remove with less highly alkaline compositions. Unfortunately, alkalis readily corrode and dissolve soft metals. Metal discoloration, tarnishment and even pitting occur under highly basic conditions.

One response to the problem has been replacement of strong with neutral or mildly alkaline solutions that depend primarily on detergent action. For the more tenaciously held soils, the detergent action of surfactants have proved ineffective. Only light duty cleaning operations are practical for surfactants.

Sodium silicate has been widely used in passivating aluminium surfaces. However, sodium silicate cleaners suffer from several limitations. The most serious is the restriction on level of alkalinity. Therefore, the high alkalinity necessary for the removal of many soils cannot be used. Furthermore, long soaking periods or mechanical action is necessary to accomplish the release of soil.

Barium and mercury salts have been reported to potentiate the corrosive effects of the alkaline environment. In U.S. Pat. No. 2,303,398, mercuric chloride reduced the corrosion of a soft metal (tin) over that of an aqueous solution containing sodium metasilicate alone, trisodium orthophosphate alone or combinations of metasilicate and orthophosphate. Aluminum was suggested as having alkaline corrosion properties similar to that of tin. Another patent, U.S. Pat. No. 3,655,582, discloses that mixtures of barium salts with sodium metasilicate can control aqueous sodium or potassium hydroxide corrosion of aluminum.

Smectite and attapulgite clays have been described in U.S. Pat. Nos. 4,116,849 and 4,116,851 as corrosion protection agents alongside sodium silicates in aqueous alkaline hypohalite cleaners. These cleaners were directed towards pre-treating kitchen housewares, especially pots, pans, dishes, etc., which were coated with hard-to-remove food soils.

Those anti-corrosion additives of the prior art suffer a number of shortcomings. Some are ecologically toxic; others expensive. Still others are simply not effective enough under highly alkaline conditions. Thus, there continues to be a need for an aluminum surface cleaner which exhibits the efficiency of highly alkaline compositions without the attendant shortcomings.

None of the foregoing art has suggested the synergistic relationship between sodium metasilicate and either alkali metal carbonates or orthophosphates. Neither have the criticality of concentration ratios and pH ranges been previously disclosed.

The object of the present invention is to provide a simple but effective means for cleaning aluminum surfaces.

SUMMARY OF THE INVENTION

An alkaline cleaning composition for aluminum surfaces has now been found which avoids discoloring or tarnishing of the metal surface comprising a mixture of alkali metal metasilicate and a compound chosen from the group consisting of sodium carbonate, potassium carbonate, lithium carbonate, potassium orthophosphate and sodium orthophosphate and mixtures thereof, wherein the metasilicate salt is present in an effective amount up to about 3% by weight of the composition and wherein the pH ranges above about 12.0.

The present invention also provides a process for cleaning aluminum surfaces without causing significant discoloring or tarnishing of the metal surface. The process comprises:

(a) preparing an aqueous cleaning composition comprising a mixture of alkali metal metasilicate and a compound chosen from the group consisting of sodium carbonate, potassium carbonate, lithium carbonate, potassium orthophosphate and sodium orthophosphate and mixtures thereof, wherein sodium metasilicate is present in an effective amount up to about 3% by weight of the composition and wherein the pH ranges above about 12.0;

(b) applying the cleaning composition to the aluminum surface requiring cleaning; and (c) rinsing the cleaning composition from the aluminum surface.

DETAILED DESCRIPTION OF THE INVENTION

Alkali metal carbonates or orthophosphates and sodium metasilicate are the alkaline soil removing agents in the instant compositions. Applied singly, these agents, even at relatively low concentrations, will attack aluminum and other metals. Permanent damage will result ranging from a slight dulling of the metal surface to severe discoloration and corrosive pitting.

For instance, 1% or higher aqueous sodium carbonate will damage aluminum when left in contact with the metal for a sufficient period of time. A 1% sodium carbonate solution has a pH of about 11.3. Similarly, a 1% solution of potassium carbonate (pH 11.1) will produce discoloration. Higher concentrations will discolor more severaly. Sodium metasilicate concentrations above 1.15% anhydrous or 2% pentahydrate, will also damage the metal. In this case, damage begins to occur around pH 12.7. Aqueous tribasic potassium or sodium orthophosphates have deleterious effects on aluminum as well.

Unless specifically identified as anhydrous, all reference to sodium metasilicate and the orthophosphates herein shall be understood as meaning the fully hydrated forms.

Alkali-on-metal contact periods used herein are of 30 minutes duration, unless otherwise stated. While this may appear to be a rather severe test, it is not an unrealistic one. Time is needed to remove pyrolized food soils from pots, pans and oven surfaces by soaking in or spraying/brushing with an alkaline cleaning solution.

In view of the aluminum damage caused by the above alkaline agents individually, it was unexpected and surprising to find that combining carbonates or orthophosphates with relatively small concentrations of metasilicate minimized or altogether prevented the attack of metal surfaces.

Non-damaging ratios of sodium carbonate to sodium metasilicate extend from about 20:1 to about 1:2 wherein sodium metasilicate is present in an effective amount up to about 1% by weight of the composition and wherein the pH ranges from about 12.3 to about 12.7. With sodium metasilicate amounts greater than 1% to about 2% the preferred ratio of sodium carbonate to sodium metasilicate is about 3.5:1 to about 1:1 with similar pH restrictions.

The limiting pH value for sodium carbonate:metasilicate combinations appears to be around 12.7; beyond this value metal attack becomes noticeable. Some sodium carbonate:metasilicate combinations of pH less than 12.7 may even damage aluminum. Combinations with pH above 12.7 will consistently do harm.

With combinations of potassium carbonate and sodium metasilicate, higher pH values may be attained without damage to aluminum. For instance, a 20% aqueous potassium carbonate solution containing 2% sodium metasilicate has a pH of 12.99. Metal remains untarnished after a 30 minute contact period. The range of non-damaging potassium carbonate:sodium metasilicate extends from about 10:1 to about 1:1 at a sodium metasilicate concentration up to about 2% and pH range from about 12.0 to 13.1. At about the 2.5% sodium metasilicate level there is practically no aluminum damage where the potassium carbonate to sodium metasilicate ratio ranges from about 4:1 to about 2.8:1.

Lithium carbonate, as other alkali metal carbonates, will attack aluminum when applied alone. In combination with sodium metasilicate, however, aluminum damage will be slight or none at all.

Non-damaging combinations of lithium carbonate with sodium metasilicate range from about 1:2 to about 1:3 at a sodium metasilicate level up to about 2% and a pH from about 12.0 to about 12.5. Low solubility confines the lithium carbonate usage level to about 0.5%. Accordingly, carbonate:metasilicate ratios are lower than in the potassium or sodium carbonate situations.

Tribasic potassium orthophosphate attacks aluminum severely, particularly when applied as a 10% or greater solution. When united with sodium metasilicate, the orthophosphate loses its metal corrosion properties. Downward adjustment of pH is unnecessary. For instance, a 10% potassium orthophosphate solution has a pH of 12.36 and tarnishes aluminum. In contrast, the same solution fortified with 1% sodium metasilicate is non-corrosive yet has a pH of 12.7. The range of non-damaging potassium orthophosphate to sodium metasilicate extends from about 30:1 to about 1:1, at a level up to about 1% sodium metasilicate and pH 12.0 to 13.0. The ratios range from about 10:1 to about 1:2 and pH 12.7–13.1 where sodium metasilicate is present in amounts greater than 1% to about 2%.

Aluminum is also damaged when it is contacted by tribasic sodium orthophosphate. Addition of small amounts of sodium metasilicate eliminates or greatly reduces the damage. Unexpectedly, alkalinity as expressed by pH is not sacrificed. The pH of the combinations is higher than that of the sodium orthophosphate alone. Non-damaging concentration ratios of sodium orthophosphate to sodium metasilicate range from about 10:1 to about 2:1, up to about 1% sodium metasilicate and pH 12.4 to 12.7. The ratios range from about 10:1 to about 1:1 and pH 12.5 to 12.8 where sodium metasilicate is present in amounts greater than 1% to about 2%.

Practical application of the present invention may require the presence of optional agents in addition to the aforedescribed alkaline systems. Adjunct materials include surfactants, solvents, thickeners, abrasives, perfumes, colorants, propellants and water. Surfactants and solvents assist the cleaning process and control sudsing. Thickeners control viscosity and flow properties. Abrasives mechanically aid cleaning. Propellants are required where compositions are intended for aerosol dispensing.

Surfactants employed in the instant composition can be chosen from nonionic, anionic, amphoteric or zwitterionic detergents.

NONIONIC SURFACTANTS

Nonionic synthetic detergents can be broadly defined as compounds produced by the condensation of alkylene oxide groups (hydrophilic in nature) with an organic hydrophobic compound, which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements. Illustrative but not limiting examples of the various chemical types of suitable nonionic surfactants include:

(a) polyoxypropylene-polyoxyethylene block polymers having the formula $$HO(CH_2CH_2O)_a(CH(CH_3)CH_2O)_b(CH_2CH_2O)_cH$$

wherein a, b, and c are integers reflecting the respective polyethylene oxide and polypropylene oxide blocks of the polymer. The polyoxyethylene component constitutes at least about 40% of the block polymer. The polymer preferably has a molecular weight of between about 1000 and 4000. These materials are well known in the art and are available under the BASF/Wyandotte "Pluronics" trademark.

(b) polyoxyethylene or polyoxypropylene condensates of alkyl phenols, whether linear- or branched-chain and unsaturated or saturated, containing from about 6 to about 12 carbon atoms and incorporating from about 5 to about 25 moles of ethylene oxide or propylene oxide. Particularly preferred are the nonyl phenoxy poly(ethyleneoxy)ethanol materials. One of these, Igepal CO-630, a trademark of GAF Corporation, was found especially useful in the present invention.

(c) polyoxyethylene or polyoxypropylene condensates of aliphatic carboxylic acids, whether linear- or branched-chain and unsaturated or saturated, containing from about 8 to about 18 carbon atoms in the aliphatic chain and incorporating from 5 to about 50 ethylene oxide or propylene oxide units. Suitable carboxylic acids include "coconut" fatty acids (derived from coconut oil) which contains an average of about 12 carbon atoms, "tallow" fatty acids (derived from tallow-class fats) which contain an average of about 18 carbon atoms, palmitic acid, myristic acid, stearic acid and lauric acid.

(d) polyoxyethylene or polyoxypropylene condensates of aliphatic alcohols, whether linear- or branched-chain and unsaturated or saturated, containing from about 8 to about 24 carbon atoms and incorporating from about 5 to about 50 ethylene oxide or propylene oxide units. Suitable alcohols include the "coconut" fatty alcohol, "tallow" fatty alcohol, lauryl alcohol, myristyl alcohol and oleyl alcohol.

(e) long chain tertiary amine oxides corresponding to the general formula, $R_1R_2R_3N\rightarrow O$, wherein $R_1$ is an alkyl radical of from about 8 to about 18 carbon atoms and $R_2$ and $R_3$ are each methyl or ethyl radicals. The arrow in the formula is a conventional representation of a semi-polar bond. Examples of amine oxides suitable for use in this invention include dimethyldodecylamine oxide, dimethyloctylamine oxide, dimethyldecylamine oxide, dimethyltetradecylamine oxide, dimethylhexadecylamine oxide.

(f) long chain tertiary phosphene oxides corresponding to the general formula $RR'R''P\rightarrow O$ wherein R is an alkyl, alkenyl or monohydroxyalkyl radical ranging from 10 to 18 carbon atoms in chain length and R' and R'' are each alkyl or monohydroxyalkyl groups containing from 1 to 3 carbon atoms. The arrow in the formula is a conventional representation of the semi-polar bond. Examples of suitable phosphene oxides are: dodecyldimethylphosphene oxide, tetradecyldimethylphosphene oxide, tetradecylmethylethylphosphene oxide, cetyldimethylphosphene oxide, stearyldimethylphosphene oxide, cetylmethylpropylphosphene oxide, dodecyldiethylphosphene oxide, tetradecyldiethylphosphene oxide, dodecyldipropylphosphene oxide, dodecyldi(hydroxymethyl)phosphene oxide, dodecyldi(2-hydroxyethyl)phosphene oxide, tetradecylmethyl-2-hydroxypropylphosphene oxide, oleyldimethylphosphene oxide and 2-hydroxydodecyldimethylphosphene oxide.

ANIONIC SURFACTANTS

Anionic synthetic detergents can be broadly described as the water-soluble salts, particularly the alkali metal salts, of organic sulfur reaction products having in their molecular structure an alkyl radical containing from about 8 to about 22 carbon atoms and a radical selected from the group consisting of sulfonic acid and sulfuric acid ester radicals. Such surfactants are well known in the detergent art and are described at length in "Surface Active Agents and Detergents", Vol. II, by Schwartz, Perry & Berch, Interscience Publishers Inc., 1958, incorporated by reference.

Among the useful anionic compounds are the higher alkyl sulfates, the higher fatty acid monoglyceride sulfates, the higher alkyl sulfonates, the sulfated phenoxy polyethoxy ethanols, the branched higher alkylbenzene sulfonates, the higher linear olefin sulfonates (e.g. hydroxyalkane sulfonates and alkenyl sulfonates, including mixtures), higher alkyl ethoxamer sulfates and methoxy higher alkyl sulfates, such as those of the formula $RO(C_2H_4O)_nSO_3M$, wherein R is a fatty alkyl of 12 to 18 carbon atoms, n is from 2 to 6 and M is a solubilizing salt-forming cation, such as an alkali metal and $$R^1-\underset{\underset{YOCO}{|}}{CH}-\underset{\underset{OSO_3X}{|}}{CH}-R^2$$

wherein $R^1$ and $R^2$ are selected from the group consisting of hydrogen and alkyls, with the total number of carbon atoms in $R^1$ and $R^2$ being in the range of 12 to 18, and X and Y are selected from the group consisting of hydrogen, alkyls from $C_1$ to $C_{20}$ and alkali metals and mixtures thereof.

As examples of suitable synthetic anionic detergents there may be cited the higher alkyl mononuclear aromatic sulfonates such as the higher alkyl benzene sulfonates containing from 10 to 16 carbon atoms in the alkyl group and a straight or branched chain, e.g., the sodium salts of decyl, undecyl, dodecyl (lauryl), tridecyl, tetradecyl, pentadecyl or hexadecyl benzene sulfonate and the higher alkyl toluene, xylene and phenol sulfonates; alkyl naphthalene sulfonate, and sodium dinonyl naphthalene sulfonate.

Other anionic detergents are the olefin sulfonates, including long chain alkene sulfonates, long chain hydroxyalkane sulfonates or mixtures thereof. These olefin sulfonate detergents may be prepared, in known manner, by the reaction of $SO_3$ with long chain olefins having 8–25, preferably 12–21 carbon atoms. Suitable olefins have the formula $RCH{=}CHR_1$, where R is alkyl and $R_1$ is alkyl or hydrogen. Sulfonation produces mixtures of sultones and alkenesulfonic acids. Further treatment converts the sultones to sulfonates. Examples of other sulfate or sulfonate detergents are paraffin sulfonates, such as the reaction products of alpha olefins and bisulfites (e.g., sodium bisulfite). These include primary paraffin sulfonates of about 10–20, preferably about 15–20 carbon atoms; sulfates of higher alcohols; and salts of α-sulfofatty ester (e.g., of about 10 to 20 carbon atoms, such as methyl α-sulfomyristate or α-sulfotallowate).

Examples of sulfates of higher alcohols are sodium lauryl sulfate, sodium tallow alcohol sulfate, Turkey Red Oil or other sulfated oils, or sulfates or mono- or diglycerides of fatty acids (e.g. stearic monoglyceride monosulfate), alkyl poly(ethoxy)ether sulfates such as the sulfates of the condensation products of ethylene oxide and lauryl alcohol (usually having 1 to 5 ethenoxy groups per molecule); lauryl or other higher alkyl glyceryl ether sulfonates; aromatic poly(ethenoxy)ether sulfates such as the sulfates of the condensation products of ethylene oxide and nonyl phenol (usually having 1 to 20 oxyethylene groups per molecule preferably 2–12).

The suitable anionic detergents include also the acyl sarcosinates (e.g. sodium lauroylsarcosinate), the acyl esters (e.g. oleic acid ester) of isethionates, and acyl N-methyl taurides (e.g. potassium N-methyl lauroyl-or oleyl tauride).

Of the various anionic detergents mentioned, the preferred salts are sodium salts and the higher alkyls are of 10 to 18 carbon atoms, preferably of 12 to 18 carbon atoms. Specific exemplifications of such compounds include: sodium linear tridecyl benzene sulfonate; sodium linear pentadecyl benzene sulfonate; sodium p-n-dodecyl benzene sulfonate; sodium lauryl sulfate; potassium coconut oil fatty acids monoglyceride sulfate; sodium dodecyl sulfonate; sodium nonyl phenoxy polyethoxy ethanol (of 30 ethoxy groups per mole); sodium propylene tetramer benzene sulfonate; sodium hydroxy-n-pentadecyl sulfonate; sodium dodecenyl sulfonate; lauryl polyethoxy ethanol sulfate (of 15 ethoxy groups per mole); and potassium methoxy-n-tetradecyl sulfate.

The most highly preferred water soluble anionic detergent compounds are the alkali metal (such as sodium and potassium) and alkaline earth metal (such as calcium and magnesium) salts of the higher alkyl benzene sulfonates, olefin sulfonates, the higher alkyl sulfates and the higher fatty acid monoglyceride sulfates. The particular salt will be suitably selected depending upon the particular formulation and the proportions therein.

Surfactants other than sulfates and sulfonates may be used. For example, the anionic surfactant may be of the phosphate mono- or diester type. These esters may be represented by the following formulas:

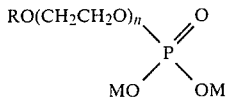

(monoester)

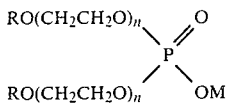

(diester)

wherein:

R is a fatty chain containing 10 to 18 atoms;

n is an integer from 0 to 5; and

M is any suitable cation such as alkali metal, ammonium and hydroxyalkyl ammonium.

Particularly preferred phosphate esters are those sold under the Gafac trademark of the GAF Corporation. Gafac PE-510 is an especially preferred phosphate ester.

Another anionic surfactant useful by itself or in combination with other surfactants for practice of this invention are the soaps. For economic reasons, it will normally be a sodium or potassium soap, but any other cation will be satisfactory that is non-toxic and does not cause unwanted side effects in the composition. The fatty acid component of the soap may be derived from mixtures of saturated and partially unsaturated fatty acids in the $C_8$–$C_{26}$ chain length region. Coconut oil and tallow, which are the traditional soap-making materials are preferred sources of the mixed fatty acids. Coconut oil contains predominantly $C_{12}$ and $C_{14}$ saturated fatty acids. Tallow contains predominantly $C_{14}$ and $C_{18}$ acids and mono-unsaturated $C_{16}$ acids. However, the invention is also particularly applicable to soaps formed from fatty acid mixtures containing high proportions of unsaturated acids such as oleic acid and linoleic acid. Sunflower seed oil is an example of an oil which contains fatty acids of this type.

Anionic surfactants are employed in amounts of about 0.20% to about 5.0% by weight of the total formulation. Preferably, the anionic surfactant is present in about 0.25% to about 1.5%.

AMPHOLYTIC SURFACTANTS

Ampholytic synthetic detergents can be broadly described as derivatives of aliphatic secondary and tertiary amines, in which the aliphatic radical may be straight chain or branched and wherein one of the aliphatic substituents contains from about 8 to about 18 carbons and one contains an anionic water solubilizing group, i.e., carboxy, sulfo, sulfato, phosphato or phosphono. Examples of compounds falling within this definition are sodium 3-dodecylamino proprionate and sodium 2-dodecylamino propane sulfonate. A particularly preferred ampholytic surfactant is Emulsogen STH, a trademark of American Hoechst Corporation, chemically identified as the sodium salt of an alkyl sulfamido carboxylic acid.

ZWITTERIONIC SURFACTANTS

Zwitterionic synthetic detergents can be broadly described as derivatives of aliphatic quaternary ammonium, phosphonium and sulfonium compounds in which the aliphatic radical may be straight chained or branched, and wherein one of the aliphatic substituents contains from about 8 to 18 carbon atoms and one contains an anionic water solubilizing group, e.g., carboxy, sulfo, sulfato, phosphato or phosphono. These compounds are frequently referred to as betaines. Besides alkyl betaines, alkylamino- and alkylamide-betaines are encompassed within this invention. Cocoamido-propyl-dimethyl betaine is a preferred surfactant for use with this invention.

SOLVENTS

Solvents may be employed in the compositions of this invention. They enhance cleaning by dissolving the fats and greases and aiding penetration into the baked-on grease. Included among the solvents are a wide range of water soluble or dispersible compounds. Suitable solvents can be chosen from monohydric alcohols, polyhydric alcohols such as the alkylene glycols, alkylene glycol ethers, ketones and esters.

Alkylene glycol derived ethers are especially preferred. Among the solvents are included diethylene glycol diethyl ether (diethyl Carbitol), diethylene glycol monoethyl ether (Carbitol), diethylene glycol monobutyl ether (butyl Carbitol) and ethylene glycol monobutyl ether (butyl Cellosolve).

N-Methyl-2-pyrrolidone, sold by the GAF Corporation under the trademark M-Pyrol, is another preferred solvent.

The solvent is present in an amount from about 5% to 20% by weight.

OTHER COMPONENTS

Thickeners may be employed in the instant compositions. Cellulosic polymers are among the preferred thickeners. Examples include alkyl cellulose ethers, hydroxyalkyl cellulose ethers and carboxyalkyl cellulose ethers. Specifically, methyl cellulose, hydroxypropyl cellulose and sodium carboxymethyl cellulose are preferred. Gum based thickeners such as guar gum and its derivatives and gum tragacanth are also suitable. Furthermore, a variety of clays and other colloidal inorganics may be usefully employed as thickeners.

The compositions may contain abrasives. Calcium carbonate based minerals including calcite, dolomite or marble can be employed. Siliceous materials such as silica flour, tripoli and kieselguhr are operative abrasives herein. Mineral materials of volcanic origin such as pumice and perlite may also be included. Diatomaceous earth and a variety of clays may be advantageously employed in the instant invention. Particle sizes for the abrasives range from approximately 10 to about 150 microns.

Other adjuvants such as colorants, perfumes, suds boosters, emollients and the like can be added to enhance consumer appeal and effectiveness.

Having generally described the invention, a more complete understanding can be obtained by reference to certain specific examples which are provided herein for purposes of illustration only and are not intended to limit the invention unless otherwise specified. All parts, percentages and proportions referred to herein and in the appended claims are by weight unless otherwise indicated.

EXAMPLES

EXAMPLE 1

Aqueous solutions of sodium carbonate were prepared and applied by means of an eye dropper to aluminum sheets. After a 30 minute contact period, the sheets were rinsed with distilled water and left to dry. The following results were obtained:

| % Sod. Carbonate in Solution | Solution pH | Effect on Aluminum |
|---|---|---|
| 0.5 | 11.20 | Slight dulling, faint discoloration. |
| 1.0 | 11.31 | Slight dulling and discoloration. |
| 2.0 | 11.42 | Slight/moderate dulling and discoloration. |
| 5.0 | 11.55 | Moderate dulling and discoloration. |
| 7.0 | 11.61 | Distinct dulling and discoloration. |
| 10.0 | 11.69 | Distinct dulling and discoloration. |

The attack on aluminum was accompanied by slight frothing of the solutions denoting gas formation.

EXAMPLE 2

Aqueous solutions of sodium metasilicate were applied to aluminum as described in Example 1. The results were as follows:

| % Anhydrous Sodium Metasilicate in Solution | Equivalent % Sodium Metasilicate Pentahydrate | Solution pH | Effect on Aluminum |
|---|---|---|---|
| 0.2875 | 0.5 | 12.19 | Very faint discoloration. |
| 0.575 | 1.0 | 12.45 | Very faint discoloration. |
| 1.150 | 2.0 | 12.68 | Slight discoloration. |
| 1.725 | 3.0 | 12.81 | Slight discoloration. |
| 2.875 | 5.0 | 12.98 | Moderate dulling and discoloration. |
| 4.025 | 7.0 | 13.12 | Strong dulling and discoloration. |
| 5.750 | 10.0 | 13.24 | Severe corrosion (dulling and discoloration very heavy). |

Aluminum attack was again accompanied by distinct gas formation.

EXAMPLE 3

Using the procedure outlined in Example 1, aqueous solutions of the following mixtures of sodium carbonate and metasilicate were applied to aluminum sheets:

| % Sodium Carbonate | % Sodium Metasilicate | Solution pH | Effect on Aluminum |
|---|---|---|---|
| 0.5 | 1.0 | 12.44 | No damage |
| 2.0 | 1.0 | 12.40 | No damage |
| 5.0 | 1.0 | 12.46 | No damage |
| 10.0 | 1.0 | 12.44 | No damage |
| 20.0 | 1.0 | 12.49 | No damage |
| 9.0 | 1.5 | 12.54 | No damage |
| 0.5 | 2.0 | 12.67 | No damage |
| 1.0 | 2.0 | 12.67 | No damage |
| 5.0 | 2.0 | 12.65 | No damage |
| 8.0 | 2.0 | 12.63 | Faint dulling |

This example clearly illustrates that the combinations of sodium carbonate and metasilicate do not damage aluminum while the individual components, as shown in Examples 1 and 2, cause damage.

Three parameters are critical to avoidance of corrosion; these are the total sodium metasilicate amount, the ratio of sodium carbonate to sodium metasilicate and the solution pH. In regard to the pH factor, the following formulation was prepared.

| Component | % Formula | Grams |
|---|---|---|
| Sodium Carbonate | 20 | 11.34 |
| Sodium Metasilicate | 30 | 17.01 |
| Sodium Gluconate | 10 | 5.67 |
| Distilled Water | 40 | 22.68 |
| | | 56.70 |

The entire 56.70 gram sample of the above composition was added to 3785 grams water (1 gallon) resulting in a solution having a pH of 12.21. This solution was evaluated for aluminum compatibility by the test outlined in Example 1. The composition tarnished aluminum.

EXAMPLE 4

Aqueous solutions of potassium carbonate were prepared and applied by a method identical to that described in Example 1. The following results were obtained:

| % Potassium Carbonate in Solution | Solution pH | Effect on Aluminum |
|---|---|---|
| 1.0 | 11.13 | Slight dulling and discoloration. |
| 2.0 | 11.29 | Slight dulling and dis coloration. |
| 3.0 | 11.35 | Slight/moderate dulling and discoloration. |
| 5.0 | 11.50 | Slight/moderate dulling and discoloration. |

The table demonstrates that potassium carbonate, when applied alone, at levels of 1% and above will attack aluminum.

EXAMPLE 5

Using the method outlined in Example 1, mixtures of potassium carbonate and metasilicate were applied to aluminum sheets:

| % Potassium Carbonate | % Sodium Metasilicate | Solution pH | Effect on Aluminum |
|---|---|---|---|
| 2.0 | 2.0 | 12.70 | No damage |
| 7.0 | 2.0 | 12.79 | No damage |
| 7.0 | 2.5 | 12.98 | No damage |

-continued

| % Potassium Carbonate | % Sodium Metasilicate | Solution pH | Effect on Aluminum |
|---|---|---|---|
| 10.0 | 2.0 | 12.80 | No damage |
| 10.0 | 2.5 | 13.02 | No damage |
| 20.0 | 2.0 | 12.99 | No damage |
| 25.0 | 2.0 | 13.23 | Faint dulling |

The above examples illustrate again that the combinations do not damage aluminum while the individual components (Examples 2 and 4) cause damage.

EXAMPLE 6

Lithium carbonate applied to an aluminum surface according to the method of Example 1 produces the following results:

| % Lithium Carbonate | % Sodium Metasilicate | Solution pH | Effect on Aluminum |
|---|---|---|---|
| 0.5 | — | 11.23 | Dulling and discoloration |
| 0.5 | 1.0 | 12.35 | No damage |
| 0.5 | 2.0 | 12.52 | Slight dulling |

EXAMPLE 7

Potassium orthophosphate was applied to aluminum surfaces by the method described in Example 1. The following results were obtained:

| % Potassium Orthophosphate | Solution pH | Effect on Aluminum |
|---|---|---|
| 1.0 | 11.93 | Slight/moderate dulling |
| 5.0 | 11.95 | Moderate discoloration, surrounded by dull halo |
| 20.0 | 12.20 | Strong discoloration, surrounded by dull halo |

Potassium orthophosphate alone attacks aluminum quite avidly.

| % Potassium Orthophosphate | % Sodium Metasilicate | Solution pH | Effect on Aluminum |
|---|---|---|---|
| 1.0 | 1.0 | 12.41 | No damage |
| 30.0 | 1.0 | 13.00 | No damage |
| 1.0 | 2.0 | 12.69 | No damage |
| 20.0 | 2.0 | 13.01 | No damage |

Combinations of potassium orthophosphate and sodium metasilicate do not damage aluminum.

EXAMPLE 8

Aqueous solutions were prepared having various concentrations of tribasic sodium orthophosphate. They were applied to aluminum surfaces by the method described in Example 1. The following results were obtained:

| % Sodium Orthophosphate | Solution pH | Effect on Aluminum |
|---|---|---|
| 2.18 | 12.11 | Discoloration, slight dulling. |
| 6.54 | 12.37 | Slight discoloration, distinct dulling. |
| 10.9 | 12.51 | Slight discoloration, severe dulling. |

Sodium orthophosphate alone attacks aluminum.

| % Sodium Orthophosphate | % Sodium Metasilicate | Solution pH | Effect on Aluminum |
|---|---|---|---|
| 2.18 | 1.0 | 12.51 | No damage |
| 6.54 | 1.0 | 12.63 | Very faint dulling |
| 10.9 | 1.0 | 12.68 | Faint dulling/slight discoloration |
| 2.18 | 2.0 | 12.50 | No damage |
| 10.9 | 2.0 | 12.80 | Slight dulling |

Combinations of sodium orthophosphate and sodium metasilicate cause no or at most slight aluminum damage. Even the slight damage is decidedly less severe than the damage caused by orthophosphate alone. Amelioration of damage occurs without reduction in pH. In fact, the pH of the combinations are higher than that of the orthophosphate alone.

EXAMPLE 9

Sodium hydroxide was applied to aluminum surfaces by the method of Example 1. Results were as follows:

| | |
|---|---|
| 0.125% sodium hydroxide, pH 12.30 | slight dulling and discoloration |
| 0.25% sodium hydroxide, pH 12.54 | moderate dulling, slight discoloration |
| 0.125% sodium hydroxide + 1.0% sodium metasilicate, pH 12.64 | faint discoloration |
| 0.25% sodium hydroxide + 0.5% sodium metasilicate, pH 12.68 | slight dulling |

This example shows that the combinations of sodium hydroxide with sodium metasilicate are less corrosive, despite higher pH values, than sodium hydroxide alone. However, when sodium carbonate is combined with sodium metasilicate and hydroxide, the combination is more corrosive than in the absence of sodium hydroxide. The following experiments illustrate this effect.

| Composition A | | |
|---|---|---|
| Component | % Formula | Grams |
| Sodium Carbonate | 20 | 11.34 |
| Sodium Metasilicate | 30 | 17.01 |
| Sodium Hydroxide | 30 | 17.18 |
| Sodium Gluconate | 10 | 5.67 |
| Distilled Water | 10 | 6.50 |
| | | 56.70 |

The entire 56.7 gram sample of Composition A (equivalent to 2 ounces) was added to 3785 grams distilled water (equivalent to one gallon) resulting in a solution having a pH of 12.71.

| Composition B | | |
|---|---|---|
| Component | % Formula | Grams |
| Sodium Carbonate | 20 | 11.34 |
| Sodium Metasilicate | 30 | 17.01 |
| Sodium Hydroxide | 30 | 17.18 |
| Distilled Water | 20 | 11.17 |
| | | 56.70 |

The entire 56.7 gram sample of Composition B was added to 3785 grams of water resulting in a solution having a pH of 12.70.

The above two compositions were evaluated for metal corrosion according to the method described in Example 1. The solution of Compositions A and B both corroded aluminum. In contrast, similar compositions without sodium hydroxide were noncorrosive. Thus, where sodium carbonate and sodium metasilicate are combined in accordance with this invention, it is preferred that sodium hydroxide be absent.

The following examples will illustrate the practical application of our invention in pot and pan cleaning compositions.

EXAMPLE 10

The following formula represents a pot and pan cleaner in aerosol form. Ninety-three parts of the formula was blended with seven parts of Propellant A-46 (blend of propane/isobutane in 17:83 ratio).

| Component | % by Wt. |
|---|---|
| Coco/tallow soap | 0.25 |
| Potassium carbonate | 8.0 |
| Sodium metasilicate | 1.8 |
| Igepal CO-630[1] | 3.0 |
| Propylene glycol | 6.0 |
| Butyl Carbitol | 7.5 |
| Carboxymethyl cellulose | 0.625 |
| Methyl cellulose | 0.625 |
| Emulsogen STH[2] | 2.0 |
| Perfume | 0.2 |
| Water to | 100.0 |

[1]A nonionic surfactant, ex GAF, representing, generically, nonylphenoxy poly-(ethyleneoxy) ethanol.
[2]Emulsogen STH is the sodium salt of an alkyl sulfamido carboxylic acid, ex American Hoechst Corp. The presence of this material contributes to the rapid release of gas bubbles originating from the propellant. The gas bubbles contribute to quick soil removal by lifting or pulling the soil away from the substrate.

The composition outlined above was applied from an aerosol can to an aluminum tile coated with a baked-on fat/flour soil. After a 15 minute contact period, the tile was rinsed in warm water. Soil removal was complete; no mechanical assistance, such as scrubbing or brushing was necessary. The aluminum tile was not damaged by application of the alkaline composition.

Similarly, scrambled egg was baked onto a frying pan. After a 30 minute exposure to the illustrated composition and a warm water rinse, the egg was effortlessly removed. Some light brushing with a dish brush was employed.

EXAMPLE 11

The following compositions further illustrate the application of our invention:

| Component | % by Wt. A | % by Wt. B |
|---|---|---|
| Coco/tallow soap | 0.25 | 0.25 |
| Sodium carbonate | 7.0 | 8.0 |
| Sodium metasilicate | 1.0 | — |
| Gafac PE-510[1] | 0.6 | 0.6 |
| Propylene glycol | 6.0 | 6.0 |
| Methyl pyrrolidone | 15.0 | 15.0 |
| Carboxymethyl cellulose | 0.5 | 0.5 |
| Water to | 100.0 | 100.0 |
| pH (as is) | 12.50 | 11.45 |

[1]A complex organic phosphate ester, ex GAF.

The above pot and pan cleaner compositions were applied to clean aluminum tiles by brushing on. After a 20 minute contact period, the tiles were rinsed with tap water.

Composition 11A did not dull, discolor or otherwise harm the aluminum tile despite its high alkalinity (pH 12.5).

Composition 11B (pH 11.45) produced decided aluminum damage and while in contact with the aluminum surface generated gas, an indication of its reactivity with the surface.

Similar results were obtained on application of the two compositions to an aluminum alloy frying pan.

The foregoing illustrates that:

a. the pH of a composition is not the sole cause of its corrosivity, b. the presence of a small concentration of sodium metasilicate is sufficient to protect aluminum from attack by an alkali metal carbonate.

The foregoing description and examples illustrate selected embodiments of the present invention and in light thereof variations and modifications will be suggested to one skilled in the art, all of which are in the spirit and purview of this invention.

What is claimed is:

1. An aqueous alkaline cleaning composition for aluminum surfaces which avoids discoloring or tarnishing of the metal surface consisting essentially of a mixture of sodium carbonate and sodium metasilicate in the ratio of about 20:1 to about 1:2, respectively, wherein sodium metasilicate is present in an effective amount up to about 1% by weight of the composition and wherein the pH ranges from about 12.3 to about 12.7.

2. A composition according to claim 1 further comprising adjunct materials selected from the group consisting of surfactants, solvents, thickeners, abrasives, perfumes, colorants, propellants and water and mixtures thereof.

3. A composition according to claim 2 wherein the surfactant is chosen from the group consisting of nonionic, anionic, amphoteric and zwitterionic detergents and mixtures thereof.

4. A composition according to claim 1 wherein the ratio of sodium carbonate to sodium metasilicate is about 3.5:1 to about 1:1, respectively, and wherein sodium metasilicate is present in an effective amount up to about 2% by weight of the composition.

5. A method for cleaning aluminum surfaces without causing significant discoloring or tarnishing of the metal comprising applying the cleaning composition according to claim 1 to the aluminum surface and rinsing the cleaning composition therefrom.

6. A method according to claim 5 wherein the cleaning composition further comprises adjunct materials selected from the group consisting of surfactants, solvents, thickeners, abrasives, perfumes, colorants, propellants and water and mixtures thereof.

7. A method according to claim 6 wherein the surfactant is chosen from the group consisting of nonionic, anionic, amphoteric and zwitterionic detergents and mixtures thereof.

8. A method for cleaning aluminum surfaces without causing significant discoloring or tarnishing of the metal comprising applying the cleaning composition according to claim 4 to the aluminum surface and rinsing the cleaning composition therefrom.

9. A method according to claim 8 wherein the cleaning composition further comprises adjunct materials selected from the group consisting of surfactants, solvents, thickeners, abrasives, perfumes, colorants, propellants and water and mixtures thereof.

10. A method according to claim 9 wherein the surfactant is chosen from the group consisting of nonionic, anionic, amphoteric and zwitterionic detergents and mixtures thereof.

* * * * *